US010685635B2

(12) United States Patent
Inoue

(10) Patent No.: US 10,685,635 B2
(45) Date of Patent: Jun. 16, 2020

(54) SOUND TUBE HAVING A CAP, THE CAP THEREOF, AND MUSICAL INSTRUMENT INCLUDING THE SOUND TUBE

(71) Applicant: YAMAHA CORPORATION, Hamamatsu-shi (JP)

(72) Inventor: Hideyuki Inoue, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 11 days.

(21) Appl. No.: 16/138,130

(22) Filed: Sep. 21, 2018

(65) Prior Publication Data

US 2019/0019487 A1 Jan. 17, 2019

Related U.S. Application Data

(63) Continuation of application No. PCT/JP2017/011142, filed on Mar. 21, 2017.

(30) Foreign Application Priority Data

Mar. 22, 2016 (JP) ..... 2016-057308

(51) Int. Cl.

| | |
|---|---|
| ***G10K 1/07*** | (2006.01) |
| ***G10D 13/08*** | (2020.01) |
| ***G10K 1/10*** | (2006.01) |
| ***G10K 1/08*** | (2006.01) |

(52) U.S. Cl.

CPC ..... *G10K 1/07* (2013.01); *G10D 13/08* (2013.01); *G10K 1/08* (2013.01); *G10K 1/10* (2013.01)

(58) Field of Classification Search

CPC ..... G10K 1/07; G10D 13/08

See application file for complete search history.

(56) References Cited

U.S. PATENT DOCUMENTS

| | | | | |
|---|---|---|---|---|
| 1,100,671 | A * | 6/1914 | Deagan | G10D 13/08 84/403 |
| 1,100,672 | A * | 6/1914 | Deagan | G10D 13/08 84/403 |
| 2,559,334 | A | 7/1951 | Alexander | |
| 5,410,937 | A * | 5/1995 | Okamoto | G10D 13/08 116/169 |
| 9,916,820 | B2 * | 3/2018 | Inoue | G10D 13/08 |
| 2017/0278494 | A1 * | 9/2017 | Inoue | G10D 13/08 |

(Continued)

FOREIGN PATENT DOCUMENTS

| | | |
|---|---|---|
| JP | S62006798 U | 1/1987 |
| JP | H09152862 A | 6/1997 |

OTHER PUBLICATIONS

Adams. "Chimes." Adams Percussion Brochure 2015: p. 76-81. Retrieved from Web. Feb. 22, 2016. Cited in Specification.

(Continued)

*Primary Examiner* — Robert W Horn

(74) *Attorney, Agent, or Firm* — Rossi, Kimms & McDowell LLP

(57) ABSTRACT

A musical instrument includes a plurality of sound tubes that reduces the pitch of low-order harmonics included in the sound generated by the sound tube. Each sound tube can include a tubular sounding body and a cap weighing within a range inclusive from 210-300 g disposed at one end of the tubular sounding body.

11 Claims, 7 Drawing Sheets

(56) References Cited

U.S. PATENT DOCUMENTS

2019/0019487 A1* 1/2019 Inoue ..... G10K 1/10

OTHER PUBLICATIONS

International Search Report issued in Intl. Appln No. PCT/JP2017/011142 dated Jun. 6, 2017. English translation provided.
Written Opinion issued in Intl. Appln. No. PCT/JP2017/011142 dated Jun. 6, 2017.
Extended European Search Report issued in European Appln. No. 17770196.8 dated Oct. 14, 2019.

* cited by examiner

SOUND TUBE HAVING A CAP, THE CAP THEREOF, AND MUSICAL INSTRUMENT INCLUDING THE SOUND TUBE

CROSS-REFERENCE TO RELATED APPLICATIONS

The present application is a continuation application of International Application No. PCT/JP2017/011142, filed Mar. 21, 2017, which claims priority to Japanese Patent Application No. 2016-057308, filed Mar. 22, 2016. The contents of these applications are incorporated herein by reference.

BACKGROUND

The present invention relates to a musical instrument having a sound tube each having a tubular sounding body and a cap.

As a percussion instrument capable of performing a melody, there are known chimes (tubular bells) that generate sounds of different pitches by hitting a plurality of metal tubes (sound tubes) of different lengths suspended from a frame. For example, see Adams Percussion brochure 2015, pages 76-81, at:

http://www.adamsmusic.com/pageflip/pageflip.asp?u=percussio n2015&p=112&t=Adams Percussion brochure 2015.

In this type of chimes, musical performance is carried out by hitting a portion (striking part) protruding outward at an upper end part of the sound tube to cause the sound tube to generate sound, that is, to cause the sound tube to emit sound.

This type of chimes is often used for performance of orchestral music and the like. But in orchestral music and the like, chimes are often used in a form imitating church bells. For this reason, it is desirable for sounds generated by the sound tubes of the chimes to be deep like sounds from church bells. The conventional sound tube, configuration, however, does not generate sufficiently deep sound. This problem is common not only to sound tubes used for chimes, but also to tubular sounding bodies in general.

The present development solves the problems mentioned above. That is, the present sound tube can produce deeper sound using conventional tubular sound bodies.

SUMMARY

One aspect of the present invention is a sound tube for a musical instrument. The sound tube includes a tubular sounding body and a cap having a center through hole and weighing inclusive between 210-300 g disposed at one end of the tubular sounding body to reduce the pitch of low-order harmonics included in the sound generated by the sound tube.

Another aspect is the cap. The cap includes a first portion configured to extend into an interior of one end of the tubular sounding body, a second portion having an outer diameter that is larger than that of the first portion, and extending outside of the tubular sound body in a state where the cap is attached to the one end, and a center through hold extending through both the first portion and the second portion.

Another aspect is a musical instrument that includes at least one sound tube described above suspended from a support.

By setting the weight of the cap to not less than 210 g, the pitch of low-order harmonics, such as the first order harmonic to the third order harmonic, included in the sound generated by the sound tube can be lowered. By lowering the pitch of low-order harmonics this way, the sound generated by the sound tube becomes deeper. The present development thus makes it possible to make the sound generated by the sound tube deeper using the cap.

DETAILED DESCRIPTION

Figure 1:
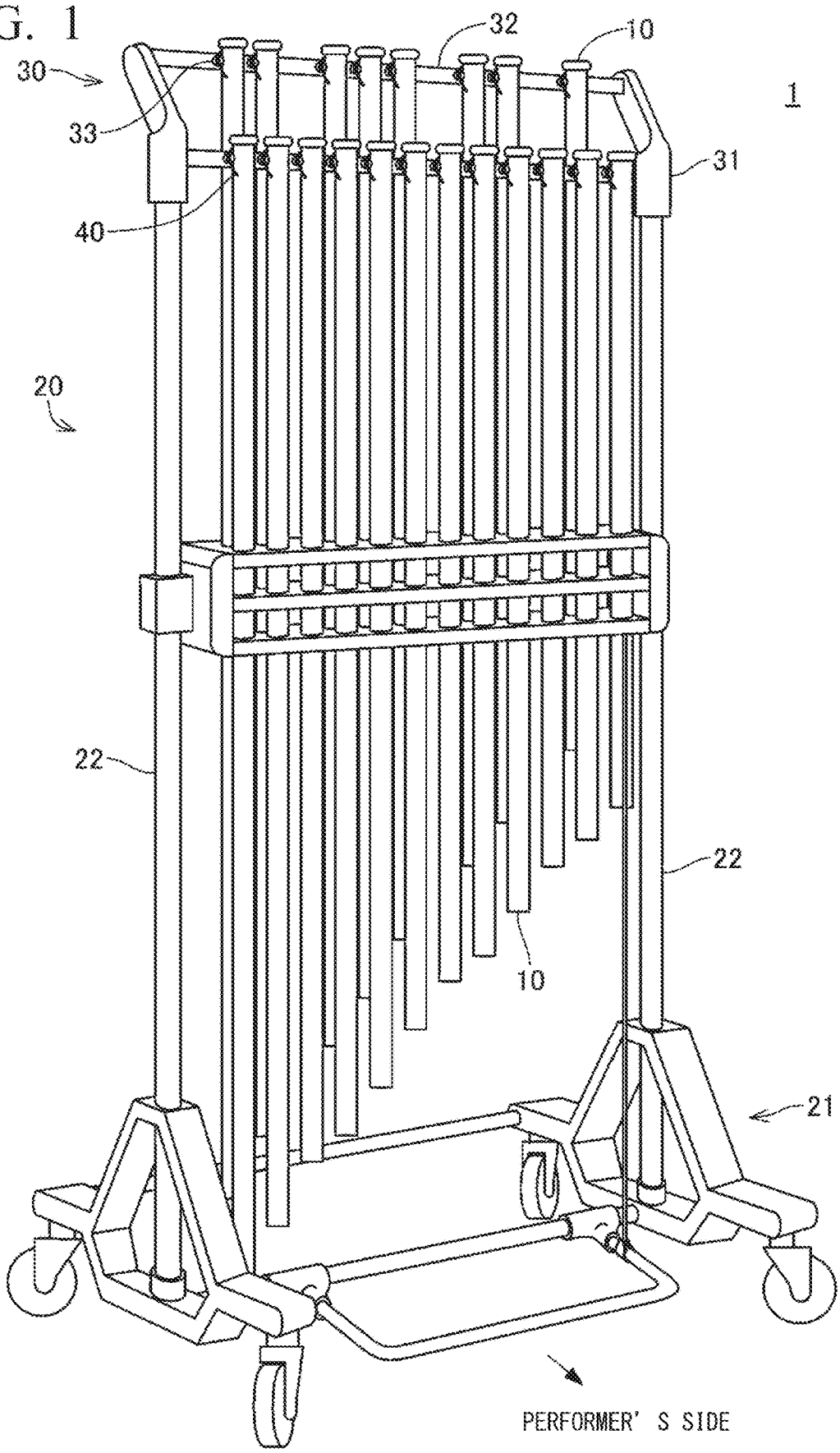
FIG. 1 is a perspective view showing an overall configuration of chimes according to an embodiment of the present invention.

FIG. 1 is a perspective view showing an overall configuration of a musical instrument, namely a chime 1 (also known as "tubular bells") according to an embodiment of the present invention. The chime 1 includes a plurality of sound tubes 10 (also known as "sound columns"), and a frame 20 for suspending the sound tubes 10. The frame 20 includes leg parts 21, two struts 22 rising perpendicularly upward from both left and right end parts of the leg parts 21, and a hanger or support 30 connecting the upper ends of the two struts 22. Here, the left and right directions, and the upward direction are directions when the chime 1 is viewed from the performer's side. Also, in the following description, unless otherwise noted in particular, upward, downward, left and right directions are each defined as directions when the chime 1 is viewed from the performer's side. In the following, front and rear directions are such that the performer's side direction is defined as the front direction and the opposite direction of the performer's side is defined as the rear direction, with the chime 1 being the reference.

The hanger 30 has two strut mounting parts 31 fixed to the struts 22 at both left and right ends, and two hanger bars 32 provided between the two strut mounting parts 31. On the hanger bar 32 there are provided hanger pins 33 that extend to the performer's side (front side). Each sound tube 10 is suspended from the hanger 30 by hanging a wire 40 attached to the sound tube 10 to the hanger pin 33 and a fixing pin (not shown in the figure) provided on the hanger bar 32. The suspension method of suspending the sound tube 10 on the hanger 30, and the specific configuration and function thereof, other than the frame 20 including the hanger 30, and the sound tube 10, can be conventional.

In the chime 1 shown in FIG. 1, the two hanger bars 32 from which the sound tubes 10 are suspended are attached to the strut mounting parts 31, in a state of being separated from each other in the front-back direction and the up-down direction. As a result, as shown in FIG. 1, the plurality of sound tubes 10 form rows on the front and on the rear, respectively. In general, the sound tubes 10 are arranged so that the sound (pitch) generated by the sound tube sequentially becomes higher with approach to the right from the left. Moreover, the sound tubes 10 for generating natural notes are arranged on the front side, and sound tubes 10 for generating derived notes are arranged on the rear side.

Figure 2:
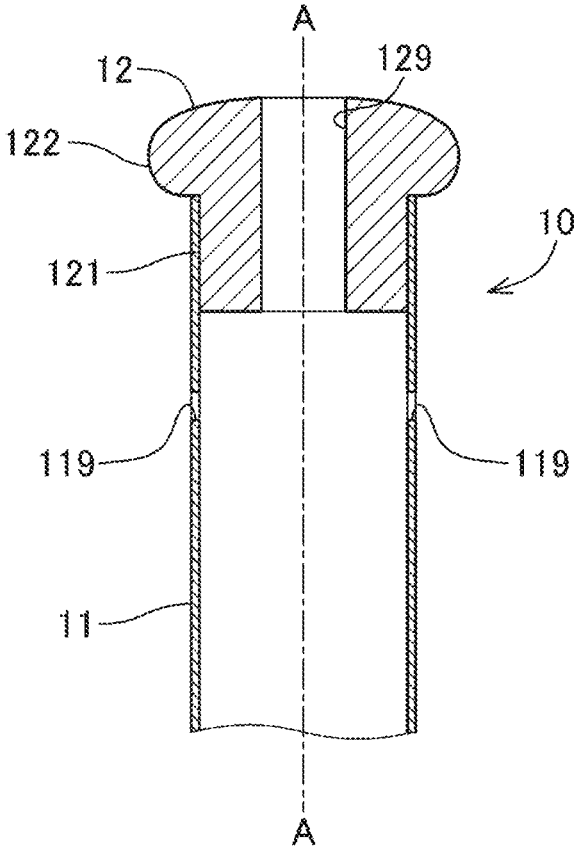
FIG. 2 is a cross-sectional view showing a sound tube of the chimes shown in FIG. 1.

FIG. 2 is a cross-sectional view of one the sound tubes 10, showing a cross-section of the sound tube 10 cut along a plane passing through a center axis A (the alternate long and short dash line in FIG. 2). The sound tube 10 extends long in the up-down direction as shown in FIG. 1. For convenience of illustration, FIG. 2 shows only the upper end part of the sound tube 10. As shown in FIG. 2, the sound tube 10 has a tubular/cylindrical sounding body 11, and a cap 12. The tubular sounding body 11 and the cap 12 are respectively members formed of a metallic material, such as brass or nickel silver and are subjected to lacquer coating or plating, such as chromium plating as necessary. The specific gravity of brass is approximately 8.5. The specific gravity of nickel silver is approximately 8.7 to 8.8. The material of the tubular sounding body 11 and the cap 12 can be a copper alloy. The specific gravity of the copper alloy is approximately 8 to 9. The copper alloy be bronze or phosphor bronze. The material of the cap 12 can be carbon steel. The specific gravity of carbon steel is approximately 7.9 to 8.0. By using carbon steel as the material of the cap 12, it is possible to manufacture the sound tube 10 at a lower cost.

In the cylindrical sounding body 11, there are formed two through holes 119 at positions that are symmetric with respect to the center axis A. A wire 40 for suspending the sound tube 10 on the hanger 30 (FIG. 1) is passed through the through holes 119 provided in the tube body 11. The cap 12 has a cylindrical attachment part (first portion) 121, and a large diameter part (second portion) 122 having an outer diameter that is larger than that of the attachment part 121. The cap 12 has a center through hole 129 passing completely through the cap 12 along the center axis A. The outer diameter of the attachment part 121 is slightly larger than the inner diameter of the tubular sounding body 11. By press-fitting the attachment part 121 into the upper end of the tubular sounding body 11, the cap 12 is assembled to the tubular sounding body 11, and the sound pipe 10 is formed.

As shown in FIG. 2, the large diameter part 122 of the cap 12 protrudes beyond the outer periphery of the tubular sounding body 11 in the state where the cap 12 is assembled to the tubular sounding body 11. Musical performance of the sound tube 10 is performed by striking the outer edge part of the large diameter part 122 that protrudes in this manner. Since the large diameter part 122 protrudes toward the outside of the tubular sounding body 11 in the state where the cap 12 is assembled to the tubular sounding body 11, it can be called an "exposed part." In contrast, the attachment part 121 of the cap 12 is in the state of being inserted in the interior of the tubular sounding body 11 in the state where the cap 12 is assembled to the tubular sounding body 11. Therefore, it can be called an "insertion part."

In addition, in the cap 12 shown in FIG. 2, the upper end side of the cap 12 is formed in a convex curved surface shape to increase the length of the large diameter part 122 in the center axis A direction as described later. By making the upper end side of the cap 12 a convex-curved surface shape in this manner, it is possible to increase the length of the large diameter part 122 in the center axis A direction without largely changing the shape of the outer edge part of the large diameter part 122. In general, the outer edge part of the large diameter part 122 is a portion to be struck at the time of performance, and hence it is gazed by the performer. Therefore, by making the upper end side of the cap 12 a the convex curved surface shape so that the shape of the outer edge part of the large diameter part 122 does not change largely, it is possible to suppress the impression that the performer receives regarding the external shape of the sound tube 10, from changing as a result of changes made in the length of the large diameter part 122.

In general, in the sound tubes 10 used for the chime 1 (FIG. 1), tuning is performed by changing the intensity, pitch, or attenuation characteristics of various harmonics generated as a result of striking, to thereby change the quality of sound generated in the sound tubes 10. Furthermore, of the various harmonics generated by being struck, the fourth harmonic is treated as a fundamental tone, and tuning is performed using the fourth harmonic. In the present embodiment, the weight of the cap 12 is set greater than that of the cap of the sound tube used for general chimes. The weight of the cap of the sound tube used for the general chimes can be, for example, 144 g or 193 g. By increasing the weight of the cap 12, the vibration mode of the sound tube 10 changes, and the intensity, pitch, and attenuation characteristics of various harmonics change. As a result, the quality of the sound generated by the sound tube 10 changes, and as the weight of the cap 12 increases, the intensity of the second order harmonic becomes greater. Therefore, the sound is felt as being deep. As the weight of the cap 12 increases, the pitch of the third order harmonic becomes lower when tuning is performed using the fourth order harmonic. As the weight of the cap 12 increases, the deviation of the integral ratio of each harmonic becomes greater. Specifically, by increasing the weight of the cap 12, sound vibrancy (sustainment of sound) of the sound tube 10 is improved, and the sound generated by the sound tube 10 becomes deeper. The effect of improving sound vibrancy of the sound is brought about by the increase in the intensity of the first and second harmonics among the harmonics included in the sound generated by the sound tube 10. Moreover, the effect of making the sound heavier is brought about by the following two phenomena. The first phenomenon is a phenomenon in which the sound tube 10 is hard to vibrate in the vibration mode for generating high-order harmonic, and the fifth order harmonic relatively attenuates earlier than the fourth order harmonic. Therefore, the fourth order harmonic becomes prominent. The second phenomenon is a phenomenon where the pitches of the first, second, and third order harmonics become lower, and the pitches of the fifth and sixth order harmonics become higher. In this way, by increasing the weight of the cap 12 that constitutes the sound tube 10, it is possible to improve sound vibrancy of the sound tube 10, and make the sound generated by the sound tube 10 deep.

If the weight of the cap 12 is made excessively high, there is a possibility that when the plurality of sound tubes 10 are arranged in the manner of the chimes 1 shown in FIG. 1, the caps 12 of the adjacent sound tubes 10 can come into contact with each other and unintended sound tubes 10 can generate sound at the time of a musical performance. On the other hand, unless the weight of the cap 12 is sufficiently high, the pitches of the first, second, and third order harmonics are not sufficiently lowered. Also, the pitches of the fifth and sixth order harmonics are not sufficiently increased. Therefore, the sound generated by the sound tube 10 does not become sufficiently deep. Taking these points into consideration, the weight of the cap 12 is preferably set in the range of 210 to 300 g as a suitable weight. Furthermore, if the weight of the cap 12 is too high, there is a possibility that the rise (attack)

of the sound when the sound tube 10 is struck become dulled. Therefore, to maintain the rise of the sound sufficiently sharp, it is more preferable for the weight of the cap 12 to be not more than 290 g. On the other hand, if the weight of the cap 12 becomes too low, the intensity of the first and second order harmonics does not increase sufficiently, and the effect of improving sound vibrancy is reduced. Accordingly, to further improve sound vibrancy, it is more preferable for the weight of the cap 12 to be not less than 220 g. It is more preferable for the weight of the cap 12 to be not less than 250 g and not more than 260 g.

Figure 3:
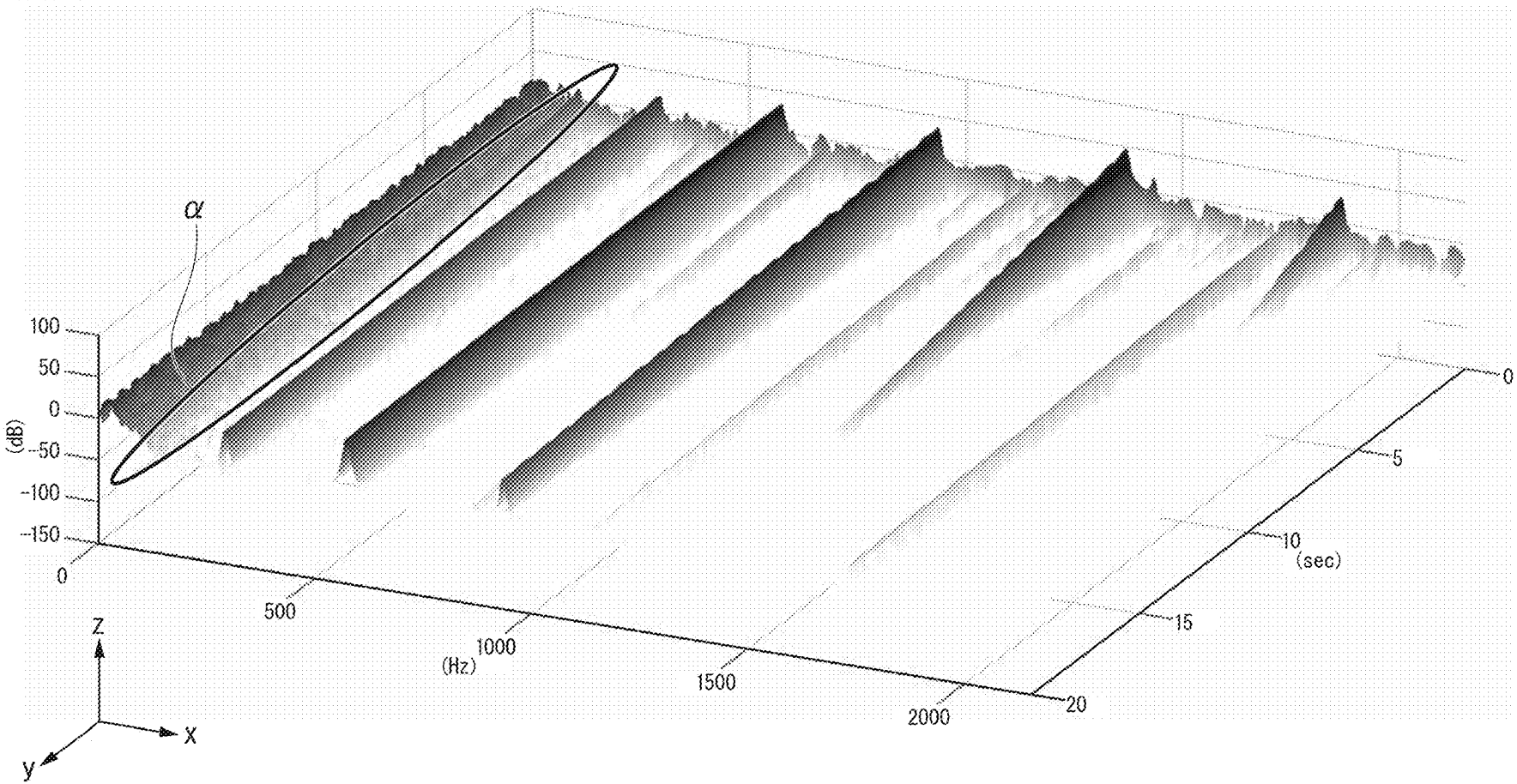
FIG. 3 is a diagram showing a result of measuring a sound emitted when the sound tube according to the present embodiment was struck.
Figure 4:
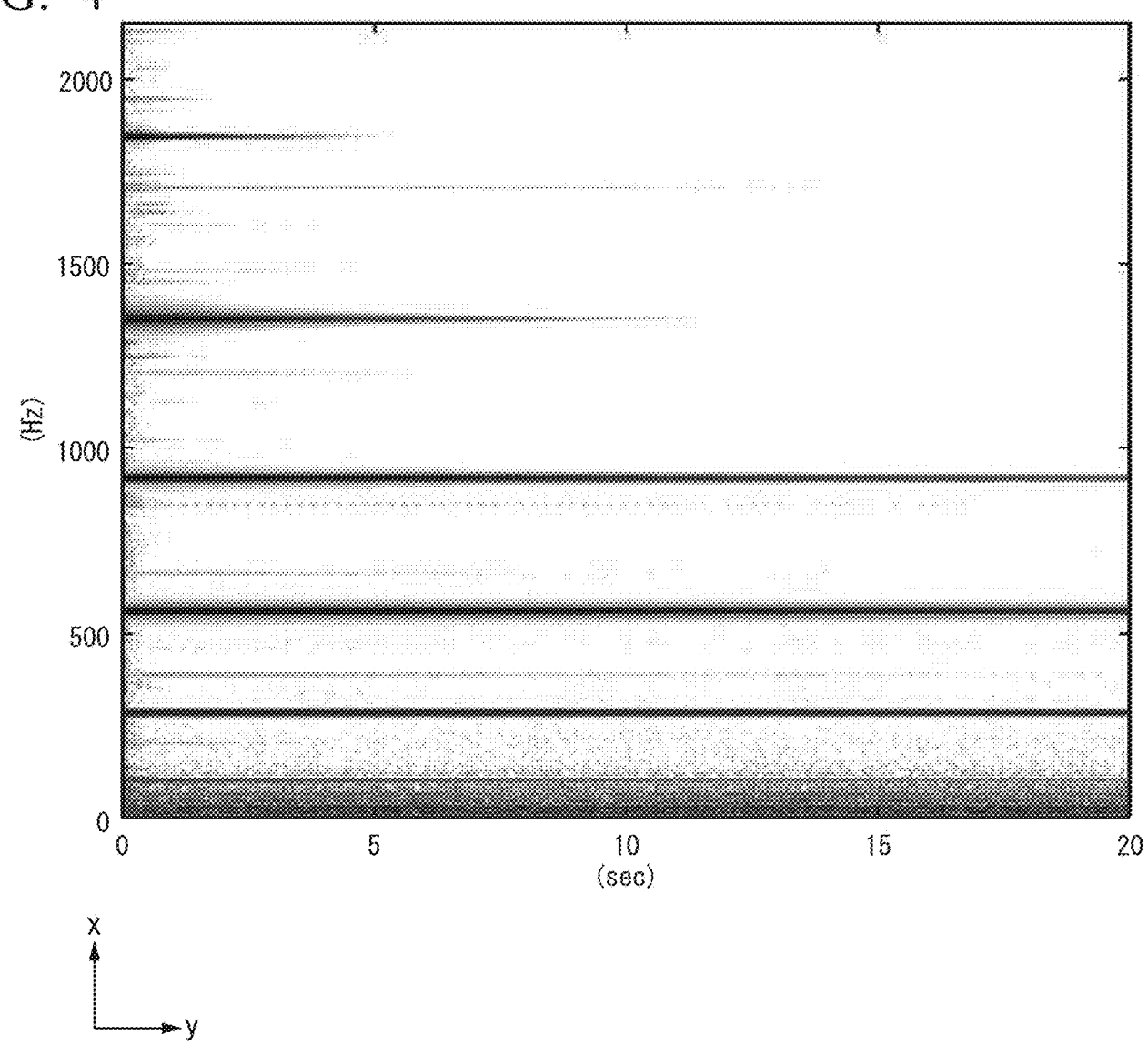
FIG. 4 is a diagram showing a state of FIG. 3 as viewed from above.
Figure 5:
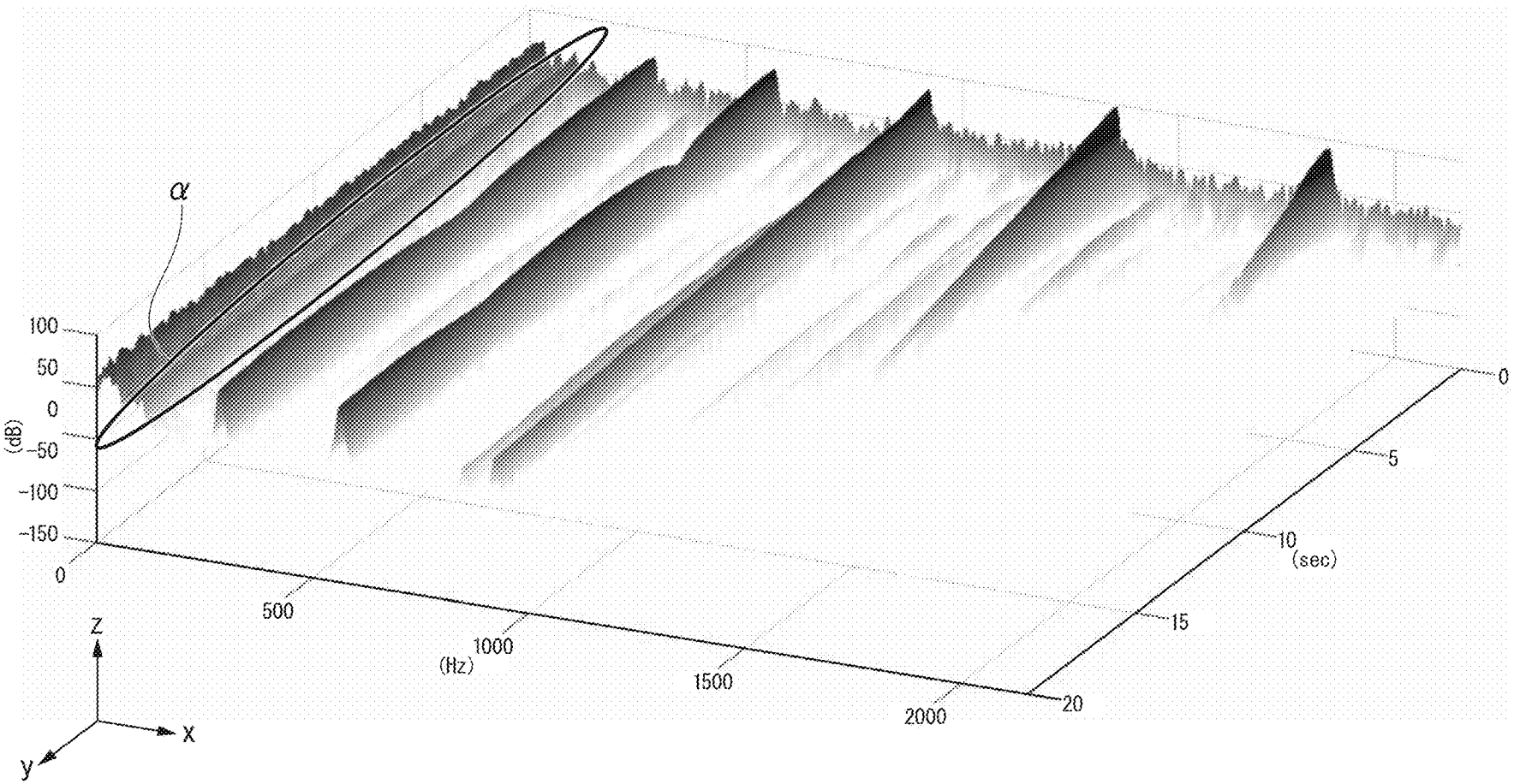
FIG. 5 is a diagram showing a comparative result of measuring a sound emitted when a sound tube with a cap outside the desired range was struck.
Figure 6:
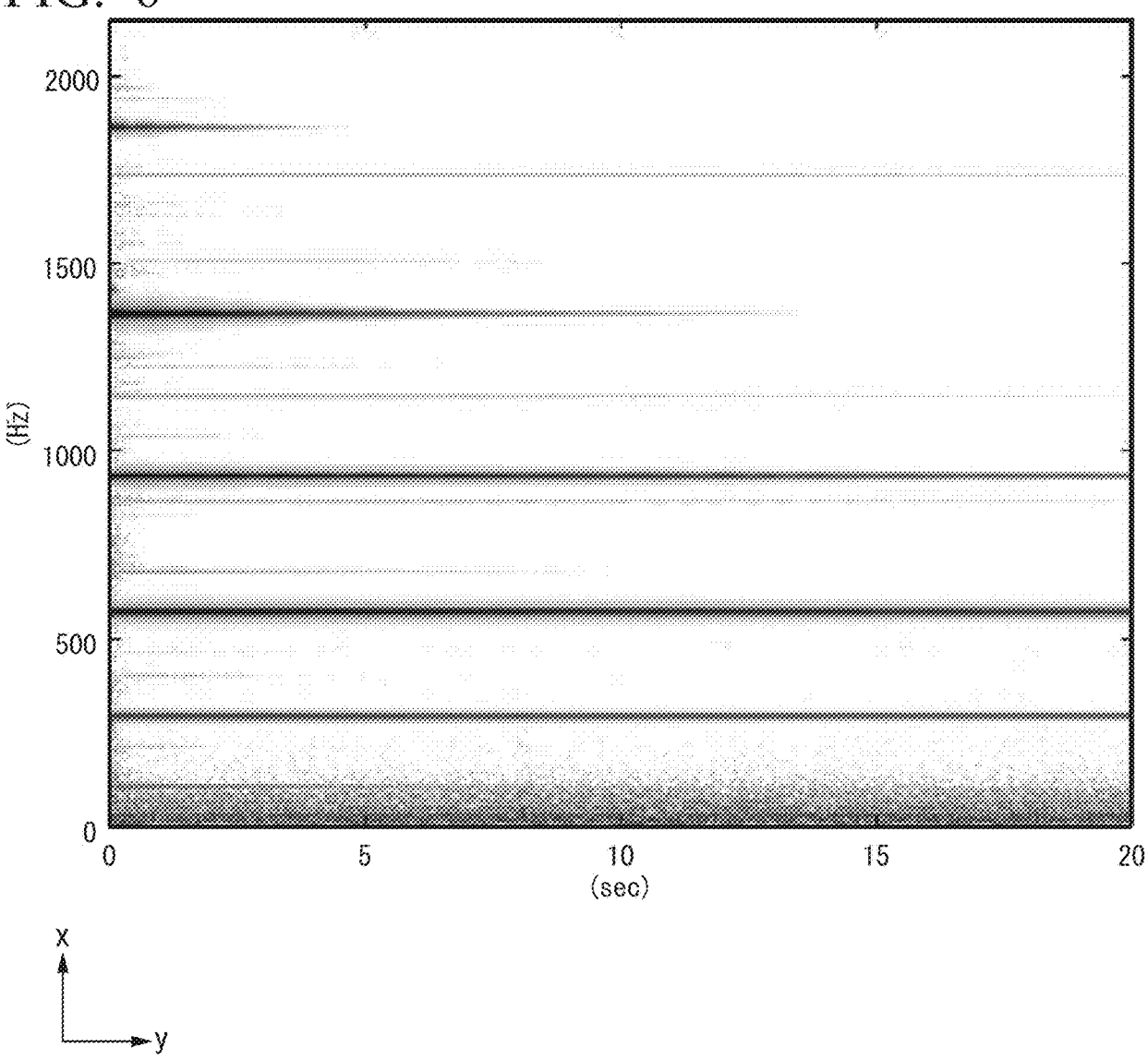
FIG. 6 is a diagram showing a state of FIG. 5 as viewed from above.

FIG. 3 and FIG. 4 are diagrams showing a result of measuring a sound emitted when the sound tube 10 according to the embodiment of the present invention is struck. FIG. 5 and FIG. 6 are diagrams showing a comparative result of measuring a sound emitted when a sound tube according to a related technique is struck. Specifically, FIG. 3 and FIG. 4 show an experimental result in a case where the weight of the cap 12 is 250 g. FIG. 5 and FIG. 6 show an experimental result in a case where the weight of the cap 12 is 144 g, which is outside the desired range. In FIG. 3, the x axis direction indicates frequency (Hz). The y axis direction indicates time (sec). The z axis direction indicates intensity (dB). FIG. 4 is a diagram showing a state of FIG. 3 as viewed from the Z direction. Reference symbol a in FIG. 3 denotes the position of the first order harmonic. The relationship between FIG. 5 and FIG. 6 is the same as the relationship between FIG. 3 and FIG. 4.

As is apparent from FIG. 3 and FIG. 4, when the weight of the cap 12 is 250 g, the intensities of the first and second order harmonics are higher. On the other hand, as is apparent from FIG. 5 and FIG. 6, when the weight of the cap 12 is 144 g, the intensities of the first and second order harmonics are lower.

As described above, by increasing the weight of the cap 12 it is possible to improve sound vibrancy of the sound tube 10, and to make the sound generated by the sound tube 10 deep. To make the weight of the cap 12 heavy, the dimensions of each part of the cap 12 are appropriately adjusted.

Figure 7:
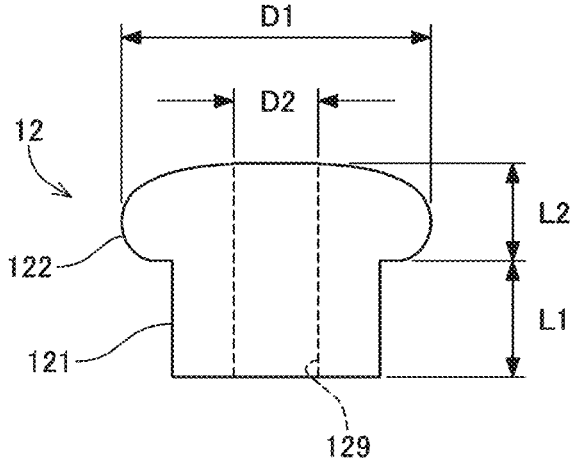
FIG. 7 is an explanatory diagram showing the dimensions of each part of the cap of the sound tube shown in FIG. 2.

FIG. 7 is an explanatory diagram showing the dimensions of each part of the cap 12 that are adjusted to make the weight of the cap 7 heavier. The weight of the cap 12 can be made heavier by adjusting the length L1 of the attachment part 121, the length L2 of the large diameter part 122, the maximum diameter D1 of the large diameter part 122, and the diameter D2 of the center hole 129 shown in FIG. 7. The length L1 of the attachment part 121 and the length L2 of the large diameter part 122 are the lengths in the center axis A direction of the sound tube 10 shown in FIG. 2, that is, the lengths in the assembly direction when the cap 12 is assembled to the tubular sounding body 11.

The weight of the cap 12 can be made heavier by increasing the maximum diameter D1 of the large diameter part 122. But if the maximum diameter D1 of the large diameter part 122 is made excessively large, the caps 12 of the adjacent sound tubes 10 come into contact with each other when arranging the plurality of sound tubes 10. The maximum diameter D1 of the large diameter part 122 is appropriately set in consideration of this point.

The weight of the cap 12 can be made heavier also by increasing either one of the length L1 of the attachment part 121 or the length L2 of the large diameter part 122. But since the attachment part 121 is positioned inside the tubular sounding body 11, if the length L1 thereof becomes too long, there is a possibility that the vibration mode of the tubular sounding body 11 is influenced. To reduce the influence on the vibration mode of the tubular sounding body 11, when increasing the weight of the cap 12, it is preferable to provide the large diameter part 122 with a proportion that is equal to or greater than the increment of the weight. In this case, the ratio of the length L2 of the large diameter part 122 to the length L1 of the attachment part 121 (L2/L1) can be set greater than or equal to a certain value. The ratio of the length L2 of the large diameter part 122 to the length L1 of the attachment part 121 (L2/L1) is preferably not less than 0.5, and more preferably not less than 0.7. In other words, the length L2 of the large diameter part 122 is preferably at least 0.5 times, and more preferably, at least 0.7 times the length L1 of the attachment part 121. The length L2 of the large diameter part 122 can be 1 time or less of the length L1 of the attachment part 121. In the present embodiment, the length L1 of the attachment part 121 is 17.5 mm, and the length L2 of the large diameter part 122 is 12 to 16 mm. In this case, the ratio (L2/L1) is approximately 0.68 to 0.92. In contrast, in the case of general caps, L2/L1 can be less than 0.5. For example, for general caps, the length of the attachment part can be 17.5 mm, and the length of the large diameter part can be 8 mm.

The weight of the cap 12 can also be increased by reducing the diameter D2 of the center hole 129 provided in the cap 12. By reducing the diameter D2 of the center hole 129, the weight of the cap 12 can be increased without changing the length L2 of the large diameter part 122 or the length L1 of the attachment part 121. Therefore, it is possible to suppress a change in the external shape of the sound tube 10 and a change in the vibration mode of the tubular sounding body 11. But if the diameter D2 of the center hole 129 is made excessively small, the sound generated by the sound tube 10 becomes muffled. The diameter D2 of the center hole 129 is preferably 6 mm or more, and more preferably 10 mm or more to keep the sound generated by the sound tube 10 from becoming muffled. In the present embodiment, the diameter D2 can be 6 to 16 mm. The diameter of the center hole provided in the general caps can be, for example, 12.7 mm or 13 mm.

In the above embodiment, preferable ranges of the weight of the cap 12 and the dimension of each part are defined for a single sound tube 10. In a modified embodiment, it is also possible to adjust the weight of the cap 12 according to the pitch of each sound tube 10 when using a plurality of sound tubes 10 having different pitches. In general, a musical instrument having a plurality of sound tubes 10 with different pitches is required to generate totally balanced sounds where the sounds generated on the lower pitch side are deeper, and the sounds generated at the higher pitch side are not excessively deep. Therefore, it is preferable to make the cap 12 of the sound tube 10 with a lower pitch heavier than the cap 12 of the sound tube 10 with a higher pitch, so that the sound generated by the sound tube 10 with a lower pitch is made sufficiently deep, while the sound generated by the sound tube 10 with a higher pitch is not excessively deep.

In the above embodiment, the chime 1 has the sound tubes 10 arranged in two rows on the front side and the rear side. In another modified embodiment the chime can have the sound tubes 10 arranged in a single row or a chime having only a single sound tube 10. Furthermore, the embodiment of the present invention can be applied not only to a musical instrument having sound tubes 10, but also to a sound tube 10 itself, which is separately provided to be able to be used in chimes. Moreover, the embodiment of the present invention is not limited to the sound tube 10 for the chime 1 that generates sound by being struck. Indeed, it also can be applied to various types of sound tubes that generate sound by other methods such as friction, as long as it is a tubular sounding body (sound tube).

Figure 8:
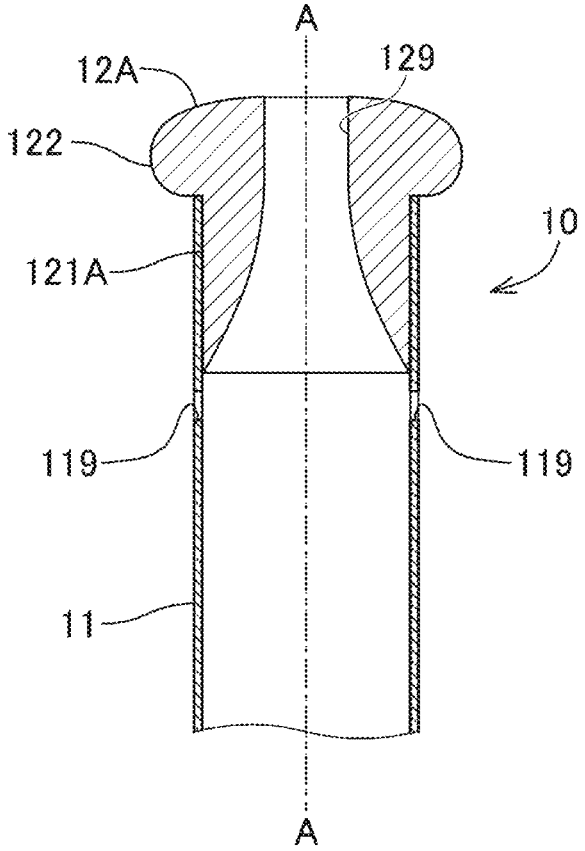
FIG. 8 is a diagram showing a modified example of the cap of the sound tube shown in FIG. 2.

The shape of the cap 12 is not limited to the shape shown in FIG. 2. FIG. 8 shows a cap 12A according to a modified example. Compared to the cap 12, the cap 12A is different in the hole shape of an attachment part 121A. In other respects, the configuration of the cap 12A is the same as that of the cap 12. As shown in FIG. 8, the diameter of the center hole 129 of the attachment part 121A gradually increases with distance from the large diameter part 122. The diameter of the center hole 129 of the large diameter part 122 can also increase gradually with distance from the edge exposed to the outside of the large diameter part 122. That is to say, at least a part of the diameter of the center hole 129 can increase gradually with distance from the edge exposed to the outside of the large diameter part 122. The length of the attachment part 121A is set to not block the through hole 119 in the state where the cap 12 is assembled to the tubular sounding body 11. Therefore, the length of the attachment part 121A is shorter than the length from one end of the tubular sounding body 11 to the through hole 119.

The sound tube according to an embodiment of the present invention thus can include a tubular sounding body and a cap that is assembled to one end of the tube body. A weight of the cap can be inclusive between 210 to 300 g. The cap can include an insertion part or first portion that is inserted into or disposed in the interior of the tubular sounding body in an assembled state where the cap is assembled to the tube body, and an exposed part or second portion that is exposed to the outside of the tubular sounding body in the assembled state. The length of the exposed part in the assembly direction when assembling the cap to the tube body can be at least 0.5 times the length of the insertion part in the assembly direction. By making the length of the exposed part at least 0.5 times the length of the insertion part, it is possible to keep the insertion part inserted into the tube body from becoming excessively long. Therefore, the influence of the insertion part on the vibration mode of the tube body itself can be further reduced.

The musical instrument according to an embodiment of the present invention can include the above sound tube. The sound tube includes at least two sound tubes having pitches different from each other. The cap provided for the sound tube having a low pitch of the two sound tubes can be heavier than the cap provided for the sound tube having a high pitch of the two sound tubes. By making the cap of the sound tube with a lower pitch heavier than the cap of the sound tube with a higher pitch, it is possible to cause the musical instrument having the sound tubes to generate totally balanced sounds where the sounds generated on the lower pitch side are sufficiently deep while the sounds generated at the higher pitch side are not excessively deep.

The embodiment of the present invention can be realized in various forms. For example, it can be realized in the form of a sound tube, or a musical instrument, such as a chime using the sound tube. The present invention thus can be applied to a sound tube.

Given the present disclosure, one versed in the art would appreciate that there can be other embodiments and modifications within the scope and spirit of the present development. Accordingly, all modifications attainable by one versed in the art from the present disclosure within the scope and spirit of the present development are to be included as further embodiments of the present development. The scope of the present invention accordingly is to be defined as set forth in the appended claims.

What is claimed is:

1. A sound tube of a musical instrument, the sound tube comprising:

a tubular sounding body; and a cap weighing inclusive between 210-300 g disposed at one end of the tubular sounding body to reduce the pitch of low-order harmonics included in the sound generated by the sound tube, and including:

a center through hole;

a first portion provided with a length L1 that extends into an interior of the one end in a longitudinal direction of the tubular sounding body; and a second portion provided with a length L2 that extends in the longitudinal direction of the tubular sounding body exposed to outside of the tubular sounding body, wherein L2/L1 is at least 0.5.

2. The sound tube according to claim 1, wherein L2/L1 is 0.5-1.0.

3. The sound tube according to claim 1, wherein L2/L1 is 0.68-0.92.

4. The sound tube according to claim 2, wherein the center through hole is provided with a diameter of at least 6 mm.

5. The sound tube according to claim 1, wherein the through hole is provided with a diameter that increases gradually, in the longitudinal direction of the tubular sounding body, from one end of the cap toward an opposite end of the cap.

6. The sound tube according to claim 1, wherein the tubular sounding body includes a pair of through holes spaced in the longitudinal direction of the tubular sounding body from an end of the first portion.

7. A cap attachable to a sound tube including a tubular sounding body for a musical instrument, for reducing the pitch of low-order harmonics included in the sound generated by the sound tube, the cap comprising:

a first portion configured to extend into an interior of one end of the tubular sounding body; and a second portion provided with an outer diameter that is larger than that of the first portion, and extending outside of the tubular sound body in a state where the cap is attached to the one end; and a center through hole extending through both the first portion and the second portion, wherein a total weight of the first portion and the second portion is inclusive between 210 to 300 g, wherein the first portion is provided with a length L1 that extends into an interior of the one end in a longitudinal direction of the tubular sounding body, in a state where the cap is attached to the tubular sounding tube, wherein the second portion is provided with a length L2 that extends in the longitudinal direction of the tubular sounding body exposed to outside of the tubular sounding body, in a state where the cap is attached to the tubular sounding tube, and wherein L2/L1 is at least 0.5.

8. The cap according to claim 7, wherein L2/L1 is 0.5-1.0.

9. The cap according to claim 7, wherein L2/L1 is 0.68-0.92.

10. The cap according to claim 8, wherein the center through hole is provided with a diameter of at least 6 mm.

11. A cap attachable to a sound tube including a tubular sounding body for a musical instrument, for reducing the pitch of low-order harmonics included in the sound generated by the sound tube, the cap comprising:

a first portion configured to extend into an interior of one end of the tubular sounding body;

a second portion provided with an outer diameter that is larger than that of the first portion, and extending outside of the tubular sound body in a state where the cap is attached to the one end; and a center through hole extending through both the first portion and the second portion, wherein a total weight of the first portion and the second portion is inclusive between 210 to 300 g, wherein the through hole is provided with a diameter that increases gradually, in the longitudinal direction of the tubular sounding body in a state where the cap is attached to the tubular sounding body, from one end of the cap toward an opposite end of the cap.

* * * * *